US007953361B2

(12) United States Patent
Obata et al.

(10) Patent No.: US 7,953,361 B2
(45) Date of Patent: May 31, 2011

(54) FIXING DEVICE AND IMAGE FORMING APPARATUS

(75) Inventors: Shigeru Obata, Ibaraki (JP); Yoshihiro Fukuhata, Hyogo (JP); Masahiro Yagi, Ibaraki (JP); Toshio Ogiso, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 576 days.

(21) Appl. No.: 11/857,783

(22) Filed: Sep. 19, 2007

(65) Prior Publication Data

US 2008/0069611 A1 Mar. 20, 2008

(30) Foreign Application Priority Data

Sep. 20, 2006 (JP) ..... 2006-254468

(51) Int. Cl.
*G03G 15/20* (2006.01)

(52) U.S. Cl. ..... 399/329; 399/320; 399/328

(58) Field of Classification Search ..... 399/67, 399/328, 330, 329
See application file for complete search history.

(56) References Cited

U.S. PATENT DOCUMENTS

| | | | | |
|---|---|---|---|---|
| 5,249,023 | A * | 9/1993 | Miyashiro et al. | 399/303 |
| 7,177,579 | B2 * | 2/2007 | Uchida et al. | 399/328 |
| 7,193,181 | B2 * | 3/2007 | Makihira et al. | 219/216 |
| 7,406,287 | B2 * | 7/2008 | Matsumoto et al. | 399/328 |
| 7,493,074 | B2 * | 2/2009 | Komuro | 399/328 |
| 7,660,553 | B2 * | 2/2010 | Kikuchi | 399/329 |
| 2002/0085866 | A1 * | 7/2002 | Okayasu et al. | 399/328 |
| 2002/0141775 | A1 * | 10/2002 | Mitsuoka et al. | 399/69 |
| 2005/0141932 | A1 * | 6/2005 | Sugiyama | 399/328 |
| 2007/0048045 | A1 * | 3/2007 | Yagi et al. | 399/329 |
| 2007/0140752 | A1 | 6/2007 | Yamamoto et al. | |
| 2007/0196145 | A1 * | 8/2007 | Matsumoto et al. | 399/329 |
| 2009/0074485 | A1 * | 3/2009 | Takada | 399/329 |

FOREIGN PATENT DOCUMENTS

| | | |
|---|---|---|
| JP | 11-167296 | 6/1999 |
| JP | 2004-13013 | 1/2004 |
| JP | 2005-301043 | 10/2005 |
| JP | 2005-338761 | 12/2005 |
| JP | 2006-343655 | 12/2006 |

* cited by examiner

*Primary Examiner* — David M Gray
*Assistant Examiner* — Francis Gray
(74) *Attorney, Agent, or Firm* — Oblon, Spivak, McClelland, Maier & Neustadt, L.L.P.

(57) ABSTRACT

The fixing device includes a fixing unit, a pressure unit that comes into pressure-contact with the fixing unit to form a nip, and control guides. The fixing unit includes a heat roller. The pressure unit includes a pressure belt, and a pressure pad. The pressure pad is attached to a holder and pressed by a spring through a stay, thereby bringing the pressure belt into pressure-contact with the heat roller. The control guides on both sides of the pressure pad control deformation of the pressure pad in an axial direction of the heat roller to make a nip shape uniform.

25 Claims, 8 Drawing Sheets

FIXING DEVICE AND IMAGE FORMING APPARATUS

CROSS-REFERENCE TO RELATED APPLICATIONS

The present application claims priority to and incorporates by reference the entire contents of Japanese priority document, 2006-254468 filed in Japan on Sep. 20, 2006.

BACKGROUND OF THE INVENTION

1. Field of the Invention

The present invention relates to a fixing device and an image forming apparatus.

2. Description of the Related Art

An image forming apparatus such as a copier, a printer, a facsimile machine generally includes a fixing device that fixes a toner image on a recording medium (hereinafter, "sheet") such as a transfer sheet or an overhead projector (OHP) sheet by heat and pressure. Japanese Patent Applications Laid-open Nos. H11-167296, 2005-301043, and 2005-338761 disclose such conventional fixing devices as a heat-roller fixing device, a belt fixing device, and a pressure-belt fixing device. The heat-roller fixing device includes a fixing roller (heat roller) that comes into pressure-contact with a pressure roller. The belt fixing device uses an endless fixing belt as a fixing member. The pressure-belt fixing device includes an endless pressure belt with which a fixing roller comes into pressure-contact.

In these conventional fixing devices, a fixing roller or a pressure roller may include an elastic layer. Alternatively, a pressing member (also referred to as a pushing member or a pressure member) that presses a fixing belt or a pressure belt to form a nip may include an elastic layer or may be formed of an elastic material (hereinafter, elastic layer and elastic material are collectively referred to as "elastic member").

Generally, the term "nip width" means a length of a nip portion in a sheet conveying direction. In the following explanation, however, a length of a nip portion in a sheet conveying direction is referred to as nip length, and a width of a nip portion in a direction perpendicular to the sheet conveying direction (roller axial direction) is referred to as nip width.

A member that directly contacts a recording medium on a fixing side (heating side) such as a fixing roller or a fixing belt is referred to as fixing member. A member that directly contacts a recording medium on a pressure side such as a pressure roller or a pressure belt is referred to as pressure member. A member that presses a pressure belt to form a nip is referred to as pressing member. A member that presses a fixing belt to form a nip on the fixing side is also referred to as pressing member.

In a fixing device, it is necessary to secure a nip long enough to obtain required fixing properties. Besides, it is desirable that nip length be uniform in the axial direction (i.e., nip width be uniform in the sheet conveying direction). When nip length is not uniform in the axial direction, even if, for example, a sufficient nip length can be obtained near the center of a sheet in a width direction, a nip length can be short at edges of the sheet in the width direction. In this case, fixing properties decrease at edges in the sheet-width direction.

In the conventional fixing devices, the elastic member is deformed due to pressure contact, which causes nip width to vary, resulting in a nonuniform nip shape (nip length is nonuniform in the axial direction). As a result, fixing properties may decrease. Thus, there is a need of a technology for preventing deformation of an elastic member at a nip portion.

SUMMARY OF THE INVENTION

It is an object of the present invention to at least partially solve the problems in the conventional technology.

According to an aspect of the present invention, a fixing device that fixes a toner image on a recording medium by heat and pressure while the recording medium is passing through a nip, includes a fixing unit, a pressure unit, and a control member. The fixing unit includes a fixing member that applies heat to the recording medium, a heat source that heats the fixing member, and a first elastic member. The pressure unit includes a pressure member that forms a nip with the fixing member, a pressure mechanism that applies pressure to the pressure member, and a second elastic member. The control member controls deformation of at least one of the first elastic member and the second elastic member in a direction perpendicular to a direction in which the recording medium is conveyed.

According to another aspect of the present invention, an image forming apparatus includes a fixing device that fixes a toner image on a recording medium by heat and pressure while the recording medium is passing through a nip. The fixing device includes a fixing unit, a pressure unit, and a control member. The fixing unit includes a fixing member that applies heat to the recording medium, and a heat source that heats the fixing member. The pressure unit includes a pressure member that forms a nip with the fixing member, and a pressure mechanism that applies pressure to the pressure member. Any one of the fixing unit and the pressure unit includes an elastic member. The control member controls deformation of the elastic member in a direction perpendicular to a direction in which the recording medium is conveyed.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Figure 1:
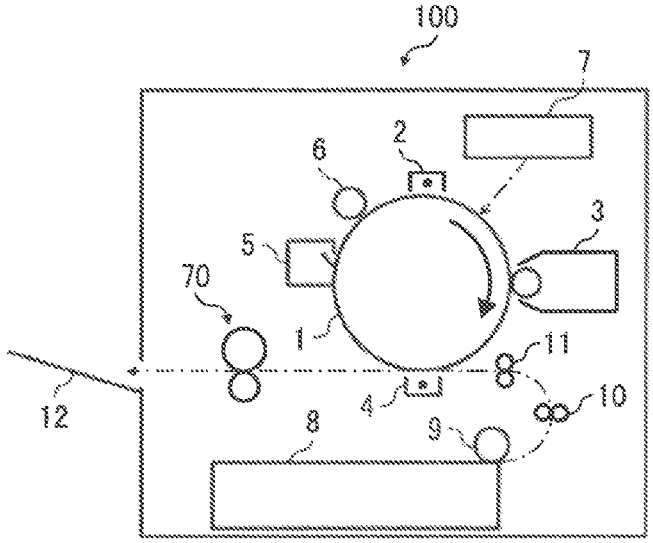
FIG. 1 is a schematic diagram of an image forming apparatus that includes a fixing device according to a first embodiment of the present invention.

FIG. 1 is a schematic diagram of a laser printer 100 as an example of an image forming apparatus that includes a fixing device according to a first embodiment of the present invention. The laser printer 100 includes a photosensitive drum 1 serving as an image carrier. Around the photosensitive drum 1 are arranged a charging unit 2, a developing device 3, a transfer unit 4, a cleaning unit 5, and an discharging unit 6. A writing device 7 is arranged above the photosensitive drum 1, and emits laser writing beams to an exposure portion of the photosensitive drum 1 between the charging unit 2 and the developing device 3.

A sheet cassette 8 is arranged at the bottom of the image forming apparatus. A feed roller 9, a pair of conveyor rollers 10, and a pair of registration rollers 11 that are arranged to feed sheets from the sheet cassette 8. A fixing device 70 is arranged in a lateral direction of a transfer portion in which the photosensitive drum 1 and the transfer unit 4 face each other.

The operation of the laser printer 100 is explained below. When the image forming operation starts, the photosensitive drum 1 is driven to rotate clockwise in FIG. 1 by a driving unit (not shown), and a surface of the photosensitive drum 1 is uniformly charged to a predetermined polarity by the charging unit 2. The writing device 7 includes a laser diode (LD) (not shown) which is driven and emits laser writing beams to the photosensitive drum 1 based on image data received from a host machine such as a personal computer (PC). Thus, an electrostatic latent image is formed on the photosensitive drum 1. The developing device 3 applies toner to the electrostatic latent image to visualize it into a toner image.

On the other hand, a recording sheet is sent out from the sheet cassette 8 through the feed roller 9 and conveyed through the pair of conveyor rollers 10. After the sheet abuts against the pair of registration rollers 11, the sheet is sent out synchronously with the visualized image so that the toner image is transferred onto the sheet at the transfer portion in which the photosensitive drum 1 and the transfer unit 4 face each other. The fixing device 70 fixes the toner image on the sheet by heat and pressure while the sheet is passing therethrough. The sheet on which the toner image has been fixed is discharged to a catch tray 12 through discharging rollers (not shown) and stacked thereon.

After the transfer of the toner image onto the sheet, the cleaning unit 5 removes matters attached to the surface of the photosensitive drum 1 such as residual toner, and the discharging unit 6 removes remaining electric charges on the surface of the photosensitive drum 1. Thus, one image forming operation is completed.

Figure 2:
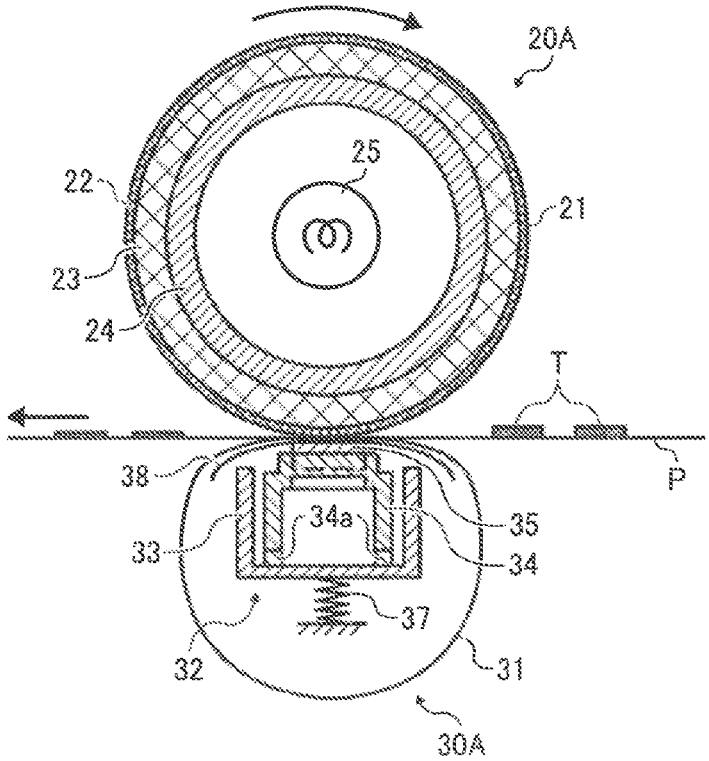
FIG. 2 is a cross section of a relevant part of the fixing device shown in FIG. 1.

FIG. 2 is a cross section of a relevant part of the fixing device 70. The fixing device 70 includes a fixing unit 20A and a pressure unit 30A. The fixing unit 20A includes a heat roller 21 as a fixing member that comes into direct contact with a sheet. The heat roller 21 includes a surface-cover layer 22, an elastic layer 23, and a cored bar 24. A fixing heater 25 serving as a heat source is arranged inside the cored bar 24. The heat roller 21 is driven by a driving unit (not shown) and rotates clockwise in FIG. 2. The pressure unit 30A includes a pressure belt 31 as a pressure member that comes into direct contact with a sheet. The pressure belt 31 is pressed by a pressure mechanism 32 and comes into pressure-contact with the heat roller 21. A sheet P such as a transfer sheet that carries an unfixed toner image T passes through a fixing nip formed between the heat roller 21 and the pressure belt 31. The unfixed toner image T is fixed on the sheet P by heat from the heat roller 21 heated by the fixing heater 25 and pressure at the fixing nip.

The surface-cover layer 22 serves as an adhesion-protective layer, i.e., a releasing layer, made of tetrafluoroethylene perfluoroakyl vinyl ether copolymer (PFA) resin so that unfixed toners are hard to adhere to the surface of the heat roller 21. Silicon rubber or fluorine rubber is generally used as the elastic layer 23. When silicon rubber is used, a fluorine layer can be coated thereon to enhance anti-swelling properties.

Figure 3:
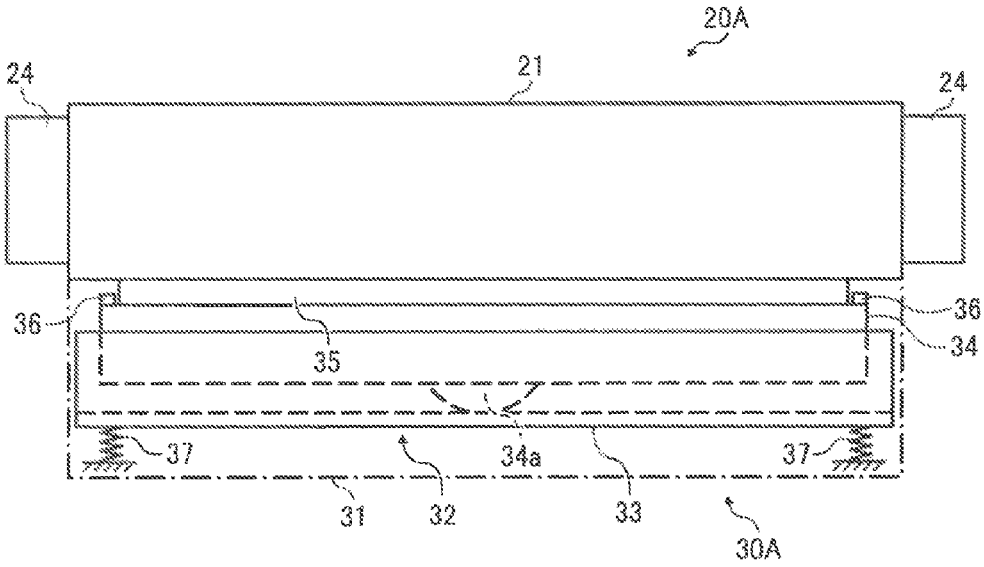
FIG. 3 is a side view of the part shown in FIG. 2.

The pressure mechanism 32 arranged in a loop of the pressure belt 31 includes, as shown in FIG. 3, a stay 33, a holder 34, a pressure pad 35 as a pressing member, control guides 36, and pressure springs 37. A predetermined fixing nip is formed by bringing the pressure belt 31 into pressure-contact with the heat roller 21. A low-friction member 38 (not shown in FIG. 3) that is made of fibers in which a lubricant is impregnated is inserted between the pressure pad 35 and the pressure belt 31. The pressure belt 31 made of a polyimide film or the like extends around the pressure mechanism 32 without exerting pressure to the pressure mechanism 32 and is driven and rotated by the heat roller 21.

The pressure pad 35 is a pressing member (nip forming member) that presses the pressure belt 31 to form a fixing nip and can be made of an elastic material such as rubber. While the pressure pad 35 is made of rubber as a whole in the first embodiment, it can include an elastic layer such as a rubber layer. An elastic member and an elastic layer other than those made of rubber can be also used. The pressure pad 35 is attached to and supported by the metal holder 34 by cure adhesion. The control guides 36 to control deformation of the pressure pad 35 in an axial direction are arranged on both sides of the pressure pad 35 (both sides of the heat roller 21 in the axial direction) on top of the holder 34. A supporting unit 34*a* that slidably supports the holder 34 with respect to the stay 33 is provided in a protruding manner at the center of a lower surface of the holder 34 in the axial direction. The stay 33 is urged in a direction of the heat roller 21 by use of the springs 37 that are arranged near both ends of the stay 33 in the axial direction. The holder 34 is slidably supported by the supporting unit 34*a* located at the center of the axial direction with respect to the stay 33. The pressure pad 35 attached to the holder 34 is pressed equally in the axial direction to the heat roller 21 by urging the stay 33 from both sides of the axial direction through the springs 37.

When the pressure pad 35 comes into pressure-contact with the heat roller 21 (via the pressure belt 31 and the low-friction member 38), the control guides 36 prevent the pressure pad 35 from being deformed in the axial direction. It is desirable that the control guide 36 be 0.5 millimeters or more lower in height (height in a pressure direction) than the pressure pad 35 (an amount of the pressure pad 35 protruded from the holder 34) while pressure is not applied because the pressure pad 35 is pressed by 0.5 millimeters when applied with pressure.

The control guides 36 are integrally formed with the metal holder 34, and thereby can be easily formed at low costs by, for example, press working from the back of the holder 34. It is also possible to form the control guides 36 integrally with the holder 34 through plastic working such as forging and heading, casting, or cutting work. The control guides 36 can be formed separately from the holder 34. The holder 34 can be formed, not limited to metal, of a rigid body such as ceramics. In this case also, the holder 34 and the control guides 36 can be integrally and separately formed.

Figure 4:
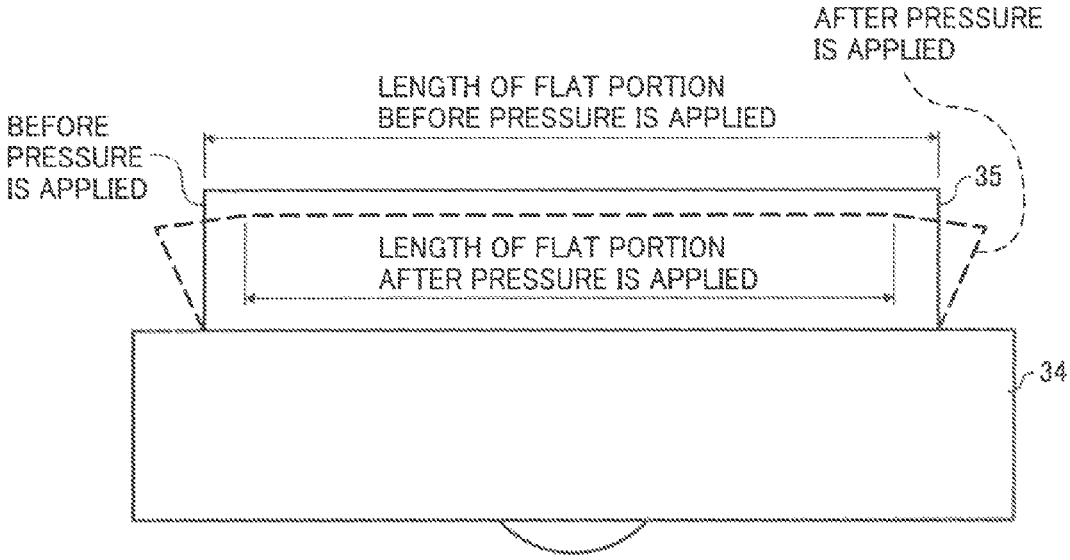
FIG. 4 is a schematic diagram for explaining a case of not including a member that controls deformation of a pressure pad shown in FIG. 2.

As shown in FIG. 4, when the control guides are not provided on both sides of the pressure pad 35, the pressure pad 35 is subjected to deformation because of pressure contact as indicated by dashed lines in FIG. 4, and a nip width that is a length of a flat portion in the axial direction (in a left-and-right direction in FIG. 6) decreases. Hence, a predetermined nip pressure cannot be obtained at ends of the pressure pad 35 in the axial direction. As a result, a nip shape is nonuniform in a central area and end areas in the axial direction of the pressure pad 35 (nip length is nonuniform in the axial direction).

Figure 5:
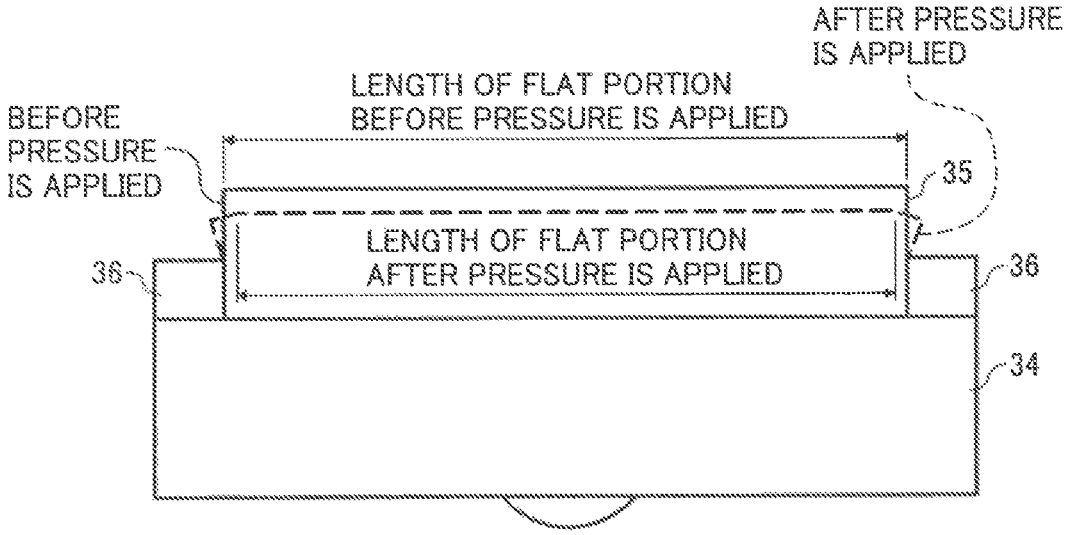
FIG. 5 is a schematic diagram for explaining an operation of the member that controls deformation of the pressure pad.

On the other hand, as shown in FIG. 5, when the control guides 36 are provided on both sides of the pressure pad 35, deformation of the pressure pad 35 in the axial direction is controlled by the control guides 36, and an amount of the deformation is significantly reduced. A nip width hardly decreases. As a result, a nip shape is almost uniform (nip length is almost uniform in the axial direction), and thereby good fixing properties can be achieved.

Figure 6:
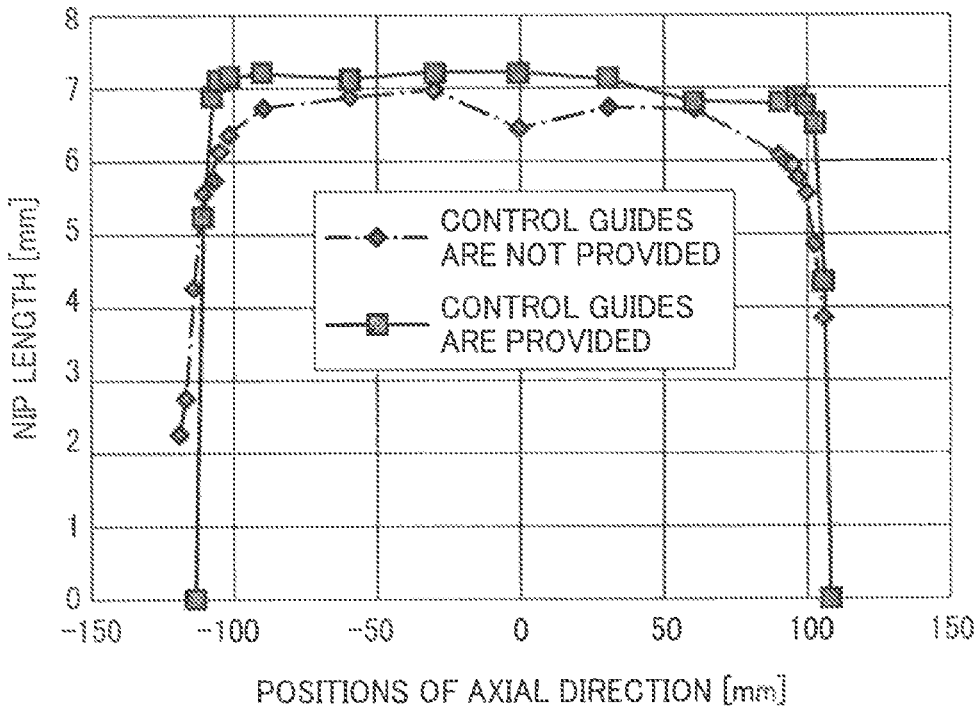
FIG. 6 is a graph of results obtained by measuring a nip length under a condition in which pressure is applied at each position in an axial direction with and without control guides.

FIG. 6 is a graph of nip lengths measured at each position of the axial direction with pressure applied when the control guides are provided and not provided. The measurements indicate results obtained by evaluating nip lengths by adding a load of 392.3 Newton (40 kilogram-force) to the heat roller 21 of the fixing device shown in FIG. 2 (manufactured by SWCC SHOWA HOLDINGS CO., LTD.) with two types of the holder 34, i.e., the ones with and without the control guides 36. The heat roller 21 has an outer diameter $\phi$ of 27.2 with the elastic layer 23 having a thickness of 1.1 millimeters, an Asker C rubber hardness of 8 Hs according to Japanese Industrial Standard-A (JIS-A), permanent deformation of 4%, and a length of 230 millimeters in the axial direction. In the measurement, rotation of the heat roller 21 was stopped while the OHP film as a recording medium was passing through a nip portion of the fixing device 70 so that the OHP film stayed at the nip portion for 10 seconds. Then, a fixing motor was rotated to take out the OHP film, and a nip trace on the OHP film was measured as nip length.

As shown in FIG. 6, when the control guides are not provided, a nip length becomes short from a position of about 90 millimeters away from the center (0 millimeter) of the axial direction. However, when the control guides 36 are provided, a nip length does not change from the center of the axial direction up to about 100 millimeters. Therefore, in the fixing device 70 with the control guides 36, a necessary (predetermined) nip length of about 200 (100+100) millimeters can be secured as a nip width so that a nip width to fully secure a letter-size printing width can be obtained. When the control guides are not provided, a predetermined nip length cannot be obtained at a position of 100 millimeters away from the center. That is, proper fixing can be performed only for sheets that correspond to a range up to about 90 millimeters from the center (180 millimeters in total).

As described above, according to the first embodiment, uniform nip length can be obtained from one edge to another in the axial direction. Thus, it is possible to prevent cold offset from occurring and obtain a high-quality image. Moreover, The fixing device performs fixing at lower temperature, and thus, electric power can be saved. Furthermore, it is not required to increase the pressure unit in size, which results in downsizing of the image forming apparatus.

Figure 7:
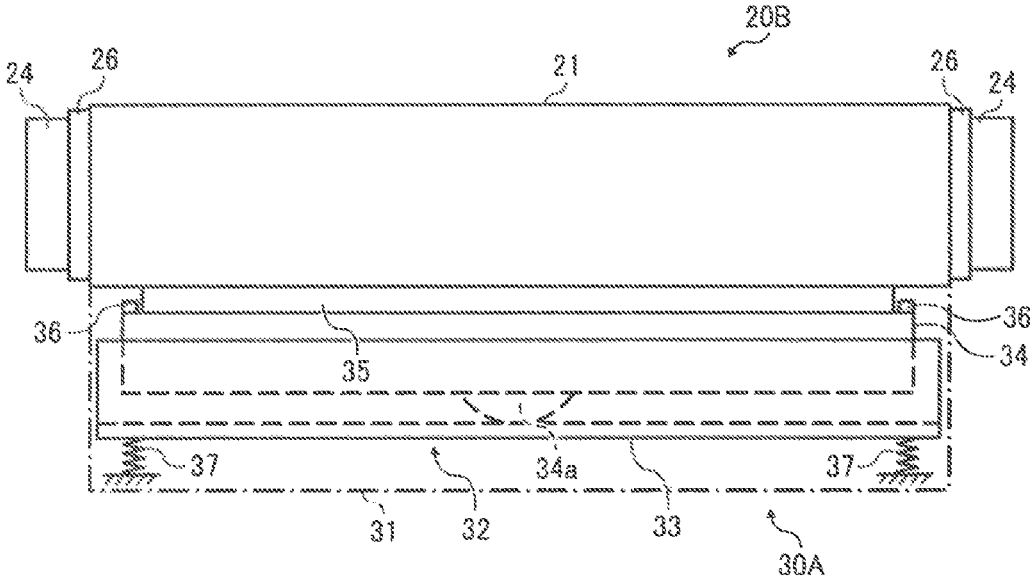
FIG. 7 is a side view of a fixing device according to a second embodiment of the present invention.

FIG. 7 is a side view of a fixing device according to a second embodiment of the present invention. Like reference characters refer to corresponding portions throughout the drawings.

The fixing device includes a fixing unit 20B and the pressure unit 30A. The fixing unit 20B is basically the same as the fixing unit 20A except that it includes control members 26 to prevent the elastic layer 23 from being deformed in the axial direction. The pressure unit 30A is the same as that shown in FIGS. 2 and 3.

The control members 26 of the fixing device are ring-shaped, fitted and fixed to the cored bar 24, and rotate with the heat roller 21. Thus, the control members 26 are static with respect to the elastic layer 23, i.e., they do not move relative to the elastic layer 23. The control members 26 are arranged adjacent to ends of the elastic layer 23 in the axial direction, and control deformation of the elastic layer 23 in the axial direction. The control members 26 can be formed integrally with the cored bar 24. In FIG. 7, the low-friction member 38 (not shown) is arranged between the pressure pad 35 and the pressure belt 31.

According to the second embodiment, with the control members 26 that control deformation of the elastic layer 23 of the heat roller 21 on the fixing unit side, in addition to the control guides 36 that control deformation of the pressure pad 35 on the pressure unit side, a nip shape can be more uniform from one edge to another in the axial direction, and good fixing properties can be achieved. Moreover, similarly to the first embodiment, it is possible to prevent a cold offset, save electric power, and downsize the image forming apparatus.

Figure 8:
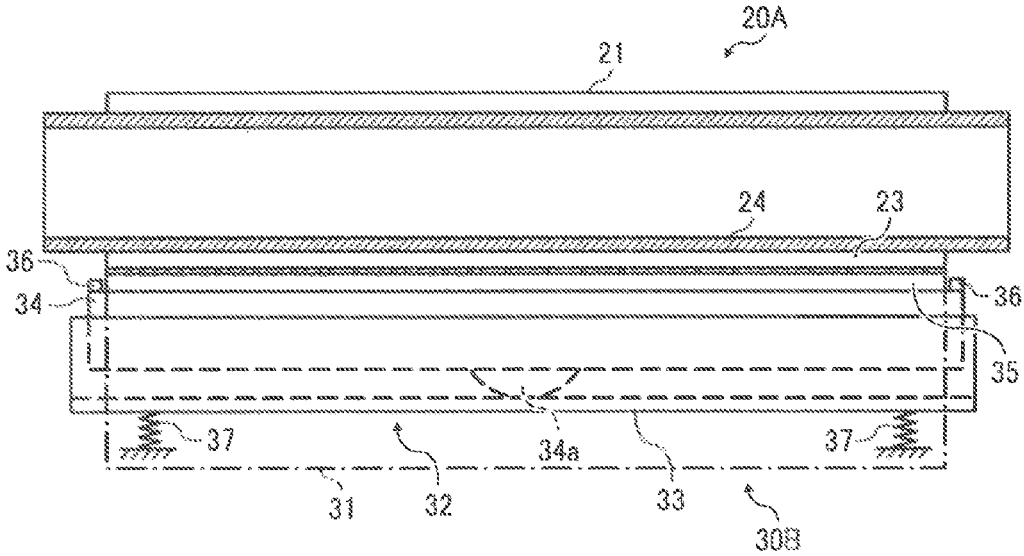
FIG. 8 is a side view of a fixing device according to a third embodiment of the present invention.

FIG. 8 is a side view of a fixing device according to a third embodiment of the present invention, and depicts a sectional view of the heat roller 21. The fixing heater 25 thereof is omitted.

The fixing device includes the fixing unit 20A and a pressure unit 30B. The fixing unit 20A is the same as that shown in FIGS. 2 and 3. The pressure unit 30B is basically similar to pressure unit 30A except that the pressure pad 35 has substantially the same width in the axial direction as that of the elastic layer 23. Accordingly, the holder 34 and the stay 33 are increased in width. While the fixing device of the third embodiment includes the control guides 36 that control deformation of the pressure pad 35 in the axial direction, it does not include control members that control deformation of the elastic layer 23 in the axial direction. However, the fixing unit 20A comes into pressure-contact with the pressure unit 30B so that the pressure pad 35 and the elastic layer 23 are in close contact with each other. Because the pressure pad 35 has substantially the same width as that of the elastic layer 23 in the axial direction, the control guides 36 can prevent deformation of the elastic layer 23 as well as preventing deformation of the pressure pad 35. In other words, the pressure pad 35 is prevented from being deformed, which, as a result, prevents the elastic layer 23 in close contact therewith from moving and being deformed in the axial direction. Thus, the same effects as described previously for the above embodiments can be achieved.

Figure 9:
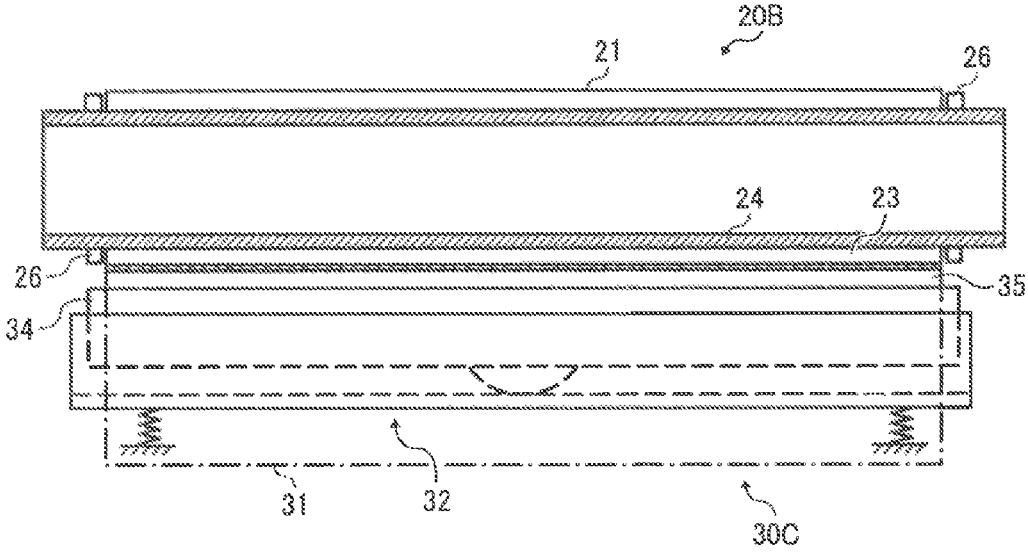
FIG. 9 is a side view of a fixing device according to a fourth embodiment of the present invention.

FIG. 9 is a side view of a fixing device according to a fourth embodiment of the present invention. The fixing device includes the fixing unit 20B and a pressure unit 30C. The fixing unit 20B is the same as that shown in FIG. 7. The pressure unit 30C is basically the same as the pressure unit 30B except that it does not include the control guides 36.

The fixing device of the fourth embodiment does not includes the control guides 36 but includes the control members 26 that control deformation of the elastic layer 23 in the axial direction. The fixing unit 20B and the pressure unit 30C come into pressure-contact with each other so that the pressure pad 35 and the elastic layer 23 are almost in close contact. Because the pressure pad 35 has substantially the same width as that of the elastic layer 23 in the axial direction, the control members 26 can prevent deformation of the pressure pad 35. In other words, the elastic layer 23 is prevented from being deformed in the axial direction by the control members 26, which, as a result, prevents the pressure pad 35 from being deformed in the axial direction. Thus, the same effects as described previously for the above embodiments can be achieved.

Figure 10:
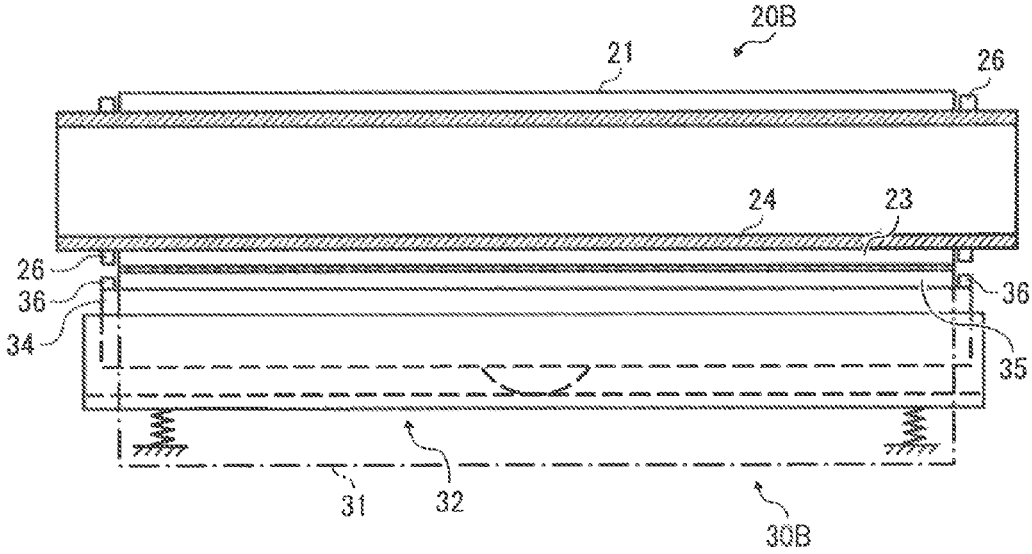
FIG. 10 is a side view of a fixing device according to a fifth embodiment of the present invention.

FIG. 10 is a side view of a fixing device according to a fifth embodiment of the present invention. The fixing device 70 includes the fixing unit 20B and the pressure unit 30B. The fixing unit 20B is the same as those shown in FIGS. 7 and 9. The pressure unit 30B is the same as that shown in FIG. 8.

The control guides 36 and the control members 26 control deformation of the pressure pad 35 and the elastic layer 23 in the axial direction, respectively. Thus, the same effects as described previously for the above embodiments can be achieved.

Based on the configurations of the above embodiments, as a specific example of the pressure pad 35, a rubber pad can be used which has an Asker C rubber hardness of 8 Hs (JIS-A), permanent deformation of 4%, and a rubber thickness of 4 millimeters in a pressure direction. It was found that, when the rubber thickness was 2 millimeters, separation performance was improved. When permanent deformation of an elastic layer of a fixing roller as a fixing member increased, a surface of the roller was subjected to local deformation, which caused image degradation such as luster variation in an image. When permanent deformation of rubber was 5% or more, luster variation was prominent. It was desirable that permanent deformation of rubber be 4% or less. Thus, permanent deformation of the elastic layer 23 is set to 4% or less in the above embodiments.

Based on the concept that the recording medium easily separates from the heating roller when a clearance between a surface of a heating roller and a surface of a recording medium at a nip exit is large, it can be understood that an outer diameter of a fixing roller is one of parameters to determine the clearance. It was found that separation performance decreased when an outer diameter $\phi$ of a fixing roller was 28 or more. Accordingly, an outer diameter $\phi$ of the heat roller 21 is set to 28 or less in the above embodiments.

A thickness of an elastic layer of a fixing roller is also one of parameters to determine the clearance. It was also found that separation performance decreased when a thickness of an elastic layer was 0.8 millimeters or less. This can be caused by, as an elastic layer of a fixing roller is reduced in thickness, elastic deformation decreases, and a protruding state of a recording medium at a nip exit cannot be properly set. Thus, the thickness of the elastic layer 23 is set to 0.8 millimeters or more in the above embodiments.

Likewise, a rubber hardness of an elastic layer of a fixing roller is one of parameters to determine the clearance. It was also found that separation performance decreased when an Asker C rubber hardness was 8 Hs (JIS-A) or more. This can be caused by, as hardness of an elastic layer of a fixing roller increases, elastic deformation decreases, and a protruding state of a recording medium at a nip exit cannot be properly set. Therefore, the Asker C hardness of the elastic layer 23 is set to 8 Hs (JIS-A) or less in the above embodiments.

When permanent deformation of rubber of a pressure pad is large, deformation occurs over time in a nip shape, and fixing and separation properties may become unstable. It was found that separation properties decreased after heating and idling of 100 hours or more when permanent deformation of rubber of a pressure pad was 5% or more. Therefore, permanent deformation of rubber of the pressure pad 35 is set to 4% or less in the above embodiments.

Figure 11:
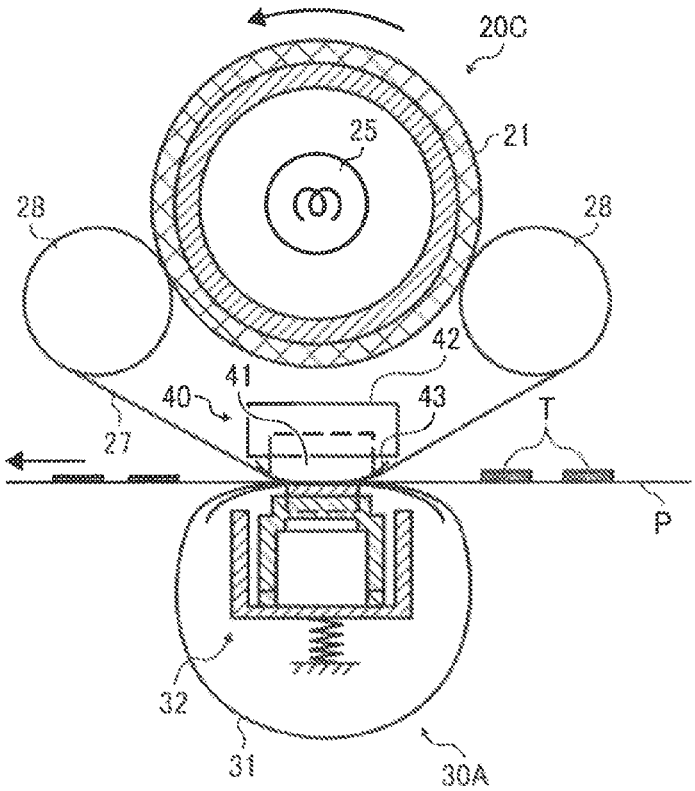
FIG. 11 is a cross section of a relevant part of a fixing device according to a sixth embodiment of the present invention.

FIG. 11 is a cross section of an relevant part of a fixing device according to a sixth embodiment of the present invention. The fixing device includes a fixing unit 20C and the pressure unit 30A. The pressure unit 30A is the same as those shown in FIGS. 2 and 7. The pressure unit 30B shown in FIG. 8 can be also used instead of the pressure unit 30A.

The fixing unit 20C is a belt fixing device that uses a fixing belt 27 that is an endless member as a fixing member. The heat roller 21 that the fixing unit 20C includes has the same configuration as the heat roller 21 shown in FIGS. 2 and 3, and the same explanation is not repeated.

As shown in FIG. 11, the fixing belt 27 as an endless fixing member extends around two supporting rollers 28 and a pushing unit 40 that makes the fixing belt 27 into pressure-contact with the pressure unit 30 to form a fixing nip. The supporting rollers 28 come into pressure-contact with the heat roller 21 via the fixing belt 27. Thus, an outer surface of the fixing belt 27 abuts the heat roller 21 between the supporting rollers 28. The pushing unit 40 includes a pressure pad 41 (rubber pad) as a pressing member (nip forming member), and a holder 42 that supports the pressure pad 41. A low-friction member 43 that includes fibers in which a lubricant is impregnated is inserted between the fixing belt 27 and the pressure pad 41.

In the above fixing device, a sheet P such as a transfer sheet carrying an unfixed toner image T passes through a fixing nip between the fixing belt 27 and the pressure belt 31 pressed by the pushing unit 40 and the pressure mechanism 32, respectively, into pressure contact. The unfixed toner image T is fixed on the sheet P by heat transmitted from the fixing belt 27 heated by the heat roller 21 and pressure at the fixing nip.

The pressure pad 41 also provided on a fixing unit side (heating side) further equalizes pressure. The control guides 36 are provided in the pressure unit 30A to control deformation of the pressure pad 35 in the axial direction. Thus, the same effects as described previously for the above embodiments can be achieved.

It is possible to provide control members (not shown), on both sides of the pressure pad 41 on the fixing unit side that control deformation of the pressure pad 41 in the axial direction in the same manner as the control guides 36 on the pressure unit side. In that case, it is possible to control deformation of the pressure pad 41 on the fixing unit side and to obtain a more uniform nip length from one edge to another in the axial direction.

As explained in connection with FIGS. 8, 9, and 10, the pressure pad 41 on the fixing unit side and the pressure pad 35 on the pressure unit side are substantially the same in width (width in the axial direction). Control guides (control members) can be provided for either or both of the pressure pads.

Figure 12:
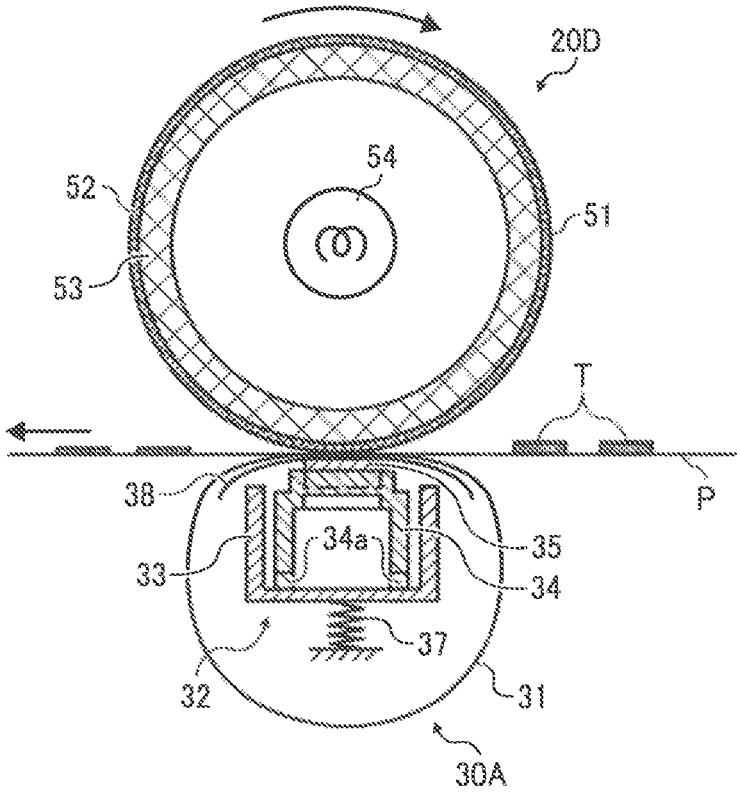
FIG. 12 is a cross section of a relevant part of a fixing device according to a seventh embodiment of the present invention.

FIG. 12 is a cross section of an relevant part of a fixing device according to a seventh embodiment of the present invention. The fixing device includes a fixing unit 20D and the pressure unit 30A. The pressure unit 30A is the same as those shown in FIGS. 2 and 7. The pressure unit 30B in FIG. 8 can also be used as a pressure unit.

The fixing unit 20D includes a heat roller 51 that is a rigid roller as a fixing member. The heat roller 51 does not include an elastic layer but includes a surface-cover layer 52, a cored bar 53, and a fixing heater 54. The pressure belt 31 to which pressure is applied by the pressure mechanism 32 comes into pressure-contact with the heat roller 51, and a fixing nip is formed due to deformation of the pressure pad 35 that is an elastic member.

When the pressure pad 35 comes into pressure-contact with the heat roller 51 via the pressure belt 31 and the low-friction member 38, deformation of the pressure pad 35 in the axial direction is controlled by the control guides 36 because the control guides 36 are provided on both sides of the pressure pad 35 (see FIG. 2).

Figure 13:
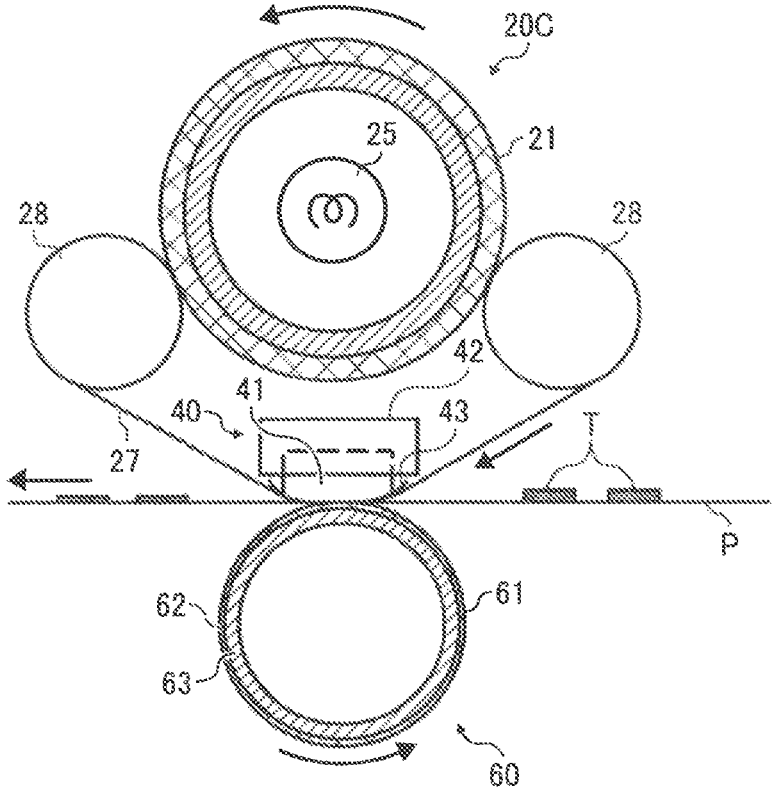
FIG. 13 is a cross section of a relevant part of a fixing device according to an eighth embodiment of the present invention.

FIG. 13 is a cross section of an relevant part of a fixing device according to an eighth embodiment of the present invention. The fixing device includes the fixing unit 20C and a pressure unit 60. The fixing unit 20C is the same as that shown in FIG. 11. The pressure unit 60 includes a pressure roller 61 that is a rigid roller as a pressure member. The pressure roller 61 does not include an elastic layer but includes a surface-cover layer 62 and a cored bar 63. A heater can be arranged inside the cored bar. A pressure roller that includes an elastic layer can be used.

Control members (not shown) are provided on both ends of the pressure pad 41 of the fixing unit 20C in the axial direction. For this reason, when the pressure pad 41 comes into pressure-contact with the pressure roller 61 via the fixing belt 27 and the low-friction member 43, deformation of the pressure pad 41 in the axial direction is controlled by the control members.

While, in the above embodiments, a pressure pad is made of rubber, other elastic materials can also be used. An elastic member (elastic layer) and control members for the elastic member can be arbitrary provided on either or both the fixing unit side and the pressure unit side individually or in combination. The pressure belt or the fixing belt can be provided in any suitable state. The pressure member (a pressure belt, a pressure roller) can be heated from a heat source. A heat source to heat the fixing member and the pressure member can be heaters such as a halogen heater, or the ones using induction heating.

The image forming apparatus is explained above as a laser printer; however, it can be a monochrome apparatus, as well as a copier, a facsimile machine, or a multifunction product that combine any or all of the functions of them. Besides, the image forming apparatus can employ an intermediate-transfer system.

As set forth hereinabove, according to an aspect of the present invention, a uniform nip length can be achieved in the axial direction, and cold offset can be prevented from occurring, which enhances the fixing performance of a fixing device. The fixing device performs fixing at lower temperature, and thus, electric power can be saved.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A fixing device that fixes a toner image on a recording medium by heat and pressure while the recording medium is passing through a nip, the fixing device comprising:

a fixing unit that includes a fixing member that applies heat to the recording medium;

a heat source that heats the fixing member; and a first elastic member;

a pressure unit that includes a pressure member that forms a nip with the fixing member;

a pressure mechanism that applies pressure to the pressure member; and a second elastic member;

a control member that controls deformation of at least one of the first elastic member and the second elastic member in a first direction perpendicular to a direction in which the recording medium is conveyed;

a stay; and a holder, a center portion of which is rotatably supported by a central region of the stay, that supports the second elastic member.

2. The fixing device according to claim 1, wherein a height of the control member is smaller than a height of the first elastic member and the second elastic member applied with pressure in a pressurizing direction in which pressure is applied to the recording medium.

3. The fixing device according to claim 2, wherein the height of the control member is smaller than the height of the first elastic member and the second elastic member applied with no pressure in the pressurizing direction by 0.5 millimeters or more.

4. The fixing device according to claim 1, wherein the pressure member is an endless pressure member, and the pressure mechanism includes the second elastic member to press the endless pressure member.

5. The fixing device according to claim 1, wherein the holder is a rigid holder.

6. The fixing device according to claim 5, wherein the holder is urged on opposite ends thereof in a direction of the nip.

7. The fixing device according to claim 5, wherein the control member is formed integrally with the holder.

8. The fixing device according to claim 1, wherein the second elastic member is a rubber member, and the rubber member has a rubber hardness equal to or less than 8 Hs according to Japanese Industrial Standard-A, and a thickness equal to or less than 2 millimeters in a rubber loading direction.

9. The fixing device according to claim 1, wherein the second elastic layer retains a permanent deformation equal to or less than 4%.

10. The fixing device according to claim 4, further comprising a low-friction member that reduces friction between the endless pressure member and the second elastic member.

11. The fixing device according to claim 1, wherein the fixing member is a fixing roller that includes a releasing layer and the first elastic layer, and the heat source is located inside the fixing roller.

12. The fixing device according to claim 11, wherein the fixing roller has an outer diameter equal to or less than 28 millimeters, and the first elastic layer has a rubber hardness equal to or less than 8 Hs according to Japanese Industrial Standard-A, and a thickness equal to or more than 0.8 millimeters.

13. The fixing device according to claim 11, wherein the first elastic layer retains a permanent deformation equal to or less than 4%.

14. The fixing device according to claim 1, wherein the fixing member is an endless fixing member, and the first elastic member presses the endless fixing member.

15. The fixing device according to claim 14, further comprising a low-friction member that reduces friction between the endless fixing member and the first elastic member.

16. An image forming apparatus comprising:

a fixing device that fixes a toner image on a recording medium by heat and pressure while the recording medium is passing through a nip, the fixing device including a fixing unit that includes a fixing member that applies heat to the recording medium, and a heat source that heats the fixing member;

a pressure unit that includes a pressure member that forms a nip with the fixing member, and a pressure mechanism that applies pressure to the pressure member, any one of the fixing unit and the pressure unit includes an elastic member; and a control member that controls deformation of the elastic member in a direction perpendicular to a direction in which the recording medium is conveyed, wherein the pressure mechanism includes:

a stay; and a holder, a center portion of which is rotatably supported by a central region of the stay, that applies pressure to the pressure member.

17. The image forming apparatus according to claim 16, wherein the holder is a rigid holder.

18. The image forming apparatus according to claim 17, wherein the holder is urged on opposite ends thereof in a direction of the nip.

19. An image forming apparatus comprising:

a fixing device that fixes a toner image on a recording medium by heat and pressure while the recording medium is passing through a nip, the fixing device including a fixing unit that includes a fixing member that applies heat to the recording medium, and a heat source that heats the fixing member;

a pressure unit that includes a pressure member that forms a nip with the fixing member, and a pressure mechanism that applies pressure to the pressure member, anyone of the fixing member and the pressure member includes an elastic member; and wherein the pressure mechanism includes:

a stay; and a holder, a center portion of which is rotatably supported by a central region of the stay, that applies pressure to the pressure member.

20. The image forming apparatus according to claim 19, wherein the holder is a rigid holder.

21. The image forming apparatus according to claim 20, wherein the holder is urged in a direction of the nip via the stay.

22. The image forming apparatus according to claim 21, further comprising:

springs at opposite ends of the stay which urge the stay in the direction of the nip.

23. The image forming apparatus according to claim 19, wherein the pressure member is an endless pressure member.

24. The image forming apparatus according to claim 23, wherein the pressure mechanism includes a rubber member which rubs against an inner surface of the endless pressure member at the nip.

25. The image forming apparatus according to claim 24, further comprising:

a low-friction member that reduces friction between the endless pressure member and the rubber member.

* * * * *